US005600958A

United States Patent [19]

Henning et al.

[11] Patent Number: 5,600,958

[45] Date of Patent: Feb. 11, 1997

[54] SHIPPER

[76] Inventors: Steve Henning, 2734 Carmel Woods Dr., Seabrook, Tex. 77586; James A. Camp, 1713 Asbury La., Deer Park, Tex. 77536

[21] Appl. No.: 413,550

[22] Filed: Mar. 30, 1995

[51] Int. Cl.[6] ..... B65B 63/09

[52] U.S. Cl. ..... 62/60; 62/372; 62/457.2

[58] Field of Search ..... 62/457.1, 457.2, 62/457.3, 457.4, 457.8, 457.9, 371, 372, 60

[56] References Cited

U.S. PATENT DOCUMENTS

| | | | |
|---|---|---|---|
| 4,377,077 | 3/1983 | Granlund . | |
| 4,446,705 | 5/1984 | Loucks . | |
| 4,517,815 | 5/1985 | Basso . | |
| 4,525,100 | 6/1985 | Zawadzki, Jr. et al. . | |
| 4,573,578 | 3/1986 | Greminger, Jr. et al. . | |
| 4,653,290 | 3/1987 | Byrne | 62/457.4 |
| 4,741,176 | 5/1988 | Johnson et al. | 62/457.4 |
| 4,947,658 | 8/1990 | Wheeler et al. . | |
| 4,955,480 | 9/1990 | Sexton | 62/372 |
| 4,964,509 | 10/1990 | Insley et al. . | |
| 4,972,945 | 11/1990 | Insley et al. . | |
| 5,029,699 | 7/1991 | Insley et al. . | |
| 5,329,778 | 7/1994 | Padamsee . | |
| 5,355,684 | 10/1994 | Guice . | |

OTHER PUBLICATIONS

ESS Sample Container Preparation and Cleaning Procedures, Apr. 1992 pp. 7–13.

*Primary Examiner*—John M. Sollecito
*Attorney, Agent, or Firm*—Jo Katherine D'Ambrosio

[57] ABSTRACT

A shipper for safely transporting materials, particularly materials which must be precooled and maintained within a predetermined temperature for the time period while in transport, is provided. The shipper has a vessel for receiving and containing the sample material. The vessel has a contiguous wall defining a vessel cavity and a port for receiving the precooled material. A lid sealably engages with the port, the lid having an inert surface adjacent to the vessel cavity. A precooled refrigerant removably jackets the vessel to maintain the precooled material within a predetermined temperature range for a given period of time. A primary safeguard assembly for enclosing the jacketed vessel comprises a receptacle having a contiguous wall defining an opening and a receptacle cavity for receiving the refrigerant-jacketed vessel. A cover seals the opening of the receptacle and a sorbent is disposed between the vessel and the receptacle wall. A secondary safeguard assembly encloses the primary safeguard assembly. The secondary safeguard assembly is comprised of an outer structual member, a liquid impermeable liner adjacent to an inner surface of the structural member, and a layer of thermal insulation disposed between the liner and the primary safeguard assembly.

21 Claims, 3 Drawing Sheets

SHIPPER

FIELD OF THE INVENTION

The present invention relates to a shipper for safely transporting materials, and more particularly to shippers for safely transporting materials which must be precooled and maintained within a predetermined temperature for the time period while in transit.

BACKGROUND OF THE INVENTION

Samples of materials to be analysed are often transported from field sites to remote laboratories. The specimen samples include enviromnental specimens, pesticides, soil and agricultural materials and biological or industrial specimens which require testing or analysis. Sample specimens are collected into either glass or plastic vessels and transported to laboratories in shippers or shipping containers. The vessels often must be precleaned and essentially contaminant-free so that the analysis is not distorted. Glass vessels are frequently used for this purpose. The materials may be either organic or inorganic as well as hazardous or non-hazardous. The method of shipping may include air freight or ground transportation.

Two critical features should be present for the safe transport of the sample specimens, especially for possibly hazardous or less stable specimens. First, the material should be maintained within a temperature range that slows down both chemical reactions and biological activity for a given period of time, typically at least 24 hours. Second, because of the possible hazardous nature of some of these samples, safeguards must be used to reduce the possibility of breakage of the vessels and, if breakage does occur, to lessen the possibility of the escape of liquids or vapors to the atmosphere.

Various types of shipping containers are presently used to transport materials. Several shipping containers are available for the transport of materials that are potentially hazardous. These containers do not provide a refrigerant, nor do they provide an essentially contaminant-free sample vessel. Refrigerant containers are available to transport materials which require cooling for a period of time, but these containers fail to have sufficient safeguards against breakage of vessels or against the subsequent leakage of potentially hazardous materials to the atmosphere.

Loucks discloses, in U.S. Pat. No. 4,446,705, an insulated storage chest having an insert formed to accomodate bottles or vials for specimens. The Loucks shipping container is constructed to retain packages of coolant mediums. Wheeler describes, in U.S. Pat. No. 4,947,658, a shipping container utilizing ice or dry ice for shipping vials or bottles of biological materials and has two compartments, the first with a refrigerant well for frozen materials and the second for unfrozen materials. Neither the Wheeler patent nor the Loucks patent disclose safeguards that protect against the leakage of hazardous materials from a broken vessel, nor are they directed to including precleaned vessels in the shipping container. An important factor which must be considered in the transport of certain samples to testing sites is that the vessels should be precleaned and essential contaminant free.

Two Insley patents, U.S. Pat. Nos. 4,964,509 and 4,972,945, purport to disclose shipping containers for hazardous materials which provide outer containers filled with highly absorbent materials said to prevent excessive movement of the damaged package and to absorb all free liquids. Neither patent teaches the use of a coolant or inner container to minimize leakage.

Greminger patent, U.S. Pat. No. 4,573,578 purports to disclose a method and safety package for transporting polar organic liquids, i.e. methanol, using ethyl cellulose as a sorbent because it forms a gel when in contact with the methanol. Zawadzki patent, U.S. Pat. No. 4,525,100, purports to disclose a system for the transport of waste materials utilizing fluid-impervious and flexible liners rather than steel drums.

Of the cylindrical containers, Insley, in U.S. Pat. No. 5,029,699 teaches a container said to have a self-sustaining housing filled with sorbent materials, specifically polyolefin microfibers. Padamsee, in U.S. Pat. No. 5,329,778, discloses a device that is a thermal, insulated bottle said to have a chamber for receiving freezable fluids. In U.S. Pat. No. 4,517,815, Basso reveals an insulated cooler for foodstuffs said to have several tubular housing sections. Granlund in U.S. Pat. No. 4,377,077 discloses a method and device for controlled freezing of cell cultures by immersion into liquid refrigerants. Similarly, Guice, in U.S. Pat. No. 5,355,684 teaches devices for the shipment of frozen biological materials said to use a cryogenically insulated vessel containing heat sink material placed in the same vessel as the biological material to be shipped.

None of the above-described devices or methods teach a shipping container that maintains a specific temperature range for a given time period, protects against the contamination of the sample specimens by either the vessel or the coolant material and also provides a safeguard against breakage and leakage during transport. Melting ice, taught by Wheeler, may contaminate the sample substances. Dry ice may freeze the specimen material. Additionally dry ice gives off vapors that may pose a danger in some shipping modes such as air transport. Maintaining a safeguard against possible leakage is critical to the safe transport of hazardous materials. Airline carriers have refused to handle containers unless strong safeguards are present.

It is apparent that a new type of shipper is desirable to replace the existing shipping containers and overcome the shortcomings of the prior known devices. A shipper having a refrigerant that maintains a precooled sample at a predetermined temperature for a given period of time and also provides a safeguard against both breakage and leakage will provide the necessary improvements lacking in the shipping containers currently available.

It is a primary feature of this invention to provide a shipper that has a refrigerant to maintain the sample materials at a predetermined temperature for a given period of time and also includes a safeguard for reducing the possibility of breakage or, if breakage occurs, reduce the possibility of leakage.

Another feature of this invention is to provide a shipper for transporting sample specimens that includes a precleaned, essentially contaminant-free vessel and a refrigerant that has shock absorbency to cushion the vessel as well as maintaining precooled materials at a predetermined temperature for a given period of time.

It is yet another feature of this invention to provide a shipper which has a refrigerant in engagement with a vessel, and both a primary safeguard assembly and a secondary safeguard assembly for reducing the possibility of breakage, or, if breakage does occur, reduces the possibility of leakage.

SUMMARY OF THE INVENTION

To achieve the foregoing features and advantages and in accordance with the purpose of the invention as embodied and broadly described herein, a shipper for transporting materials which must be precooled and maintained within a predetermined temperature range for a given period of time is provided. The shipper has a vessel for receiving and containing the sample material. The vessel has a contiguous wall defining a vessel cavity and a port for receiving precooled material. The shipper further comprises a lid sealably engaged with the port and an inert surface adjacent to the vessel cavity. A precooled refrigerant removably jackets the vessel to maintain the precooled material within a predetermined temperature range for a given period of time.

A primary safeguard assembly for enclosing the jacketed vessel comprises a receptacle having a contiguous wall defining an opening and a receptacle cavity for receiving the refrigerant-jacketed vessel and lid in sealing engagement therewith through the opening. A cover seals the opening of the receptacle, and a sorbent is disposed between the vessel and the receptacle wall. A secondary safeguard assembly encloses the primary safeguard assembly and comprises an outer structual member, a liquid impermeable liner adjacent to an inner surface of the structural member, and a layer of thermal insulation disposed between the liner and the primary safeguard assembly.

In another embodiment, the shipper comprises a vessel for receiving the sample material to be tested, a lid and a precooled refrigerant jacketing the vessel. The vessel has a contiguous wall defining a vessel cavity and a port for receiving precooled material. The lid sealably engages with the port and has an inert surface adjacent to the vessel cavity. An inner surface of the wall of the vessel cavity and the surface of the lid are precleaned to be essentially contaminant-free. A precooled refrigerant removably jackets the vessel to maintain the precooled material within a predetermined temperature range for a given period of time. The refrigerant has shock absorbancy to cushion the vessel. In a preferred embodiment, the shipper also has a primary safeguard assembly for enclosing the refrigerant-jacketed vessel. The primary safeguard comprises a receptacle having a contiguous wall defining an opening and a receptacle cavity for receiving the refrigerant-jacketed vessel and lid in sealing engagement therewith through the opening, a cover for sealing the opening of the receptacle, and a sorbent disposed between the vessel and the receptacle wall. The refrigerant comprises a flexible, elongated bag made of inert and impermeable material jacketing the vessel. The elongated bag defines a sealed reservoir containing an aqueous gel as the coolent.

In still another embodiment, the shipper comprises a generally cylindrical vessel, a precooled refrigerent sleeve jacketing the vessel and a generally cylindrical primary safeguard. The generally cylindrical vessel has a contiguous wall defining a vessel cavity and a port formed adjacent an upper end of the vessel for receiving precooled material. A lid sealably engages with the port and has an inert surface adjacent to the vessel cavity. The inner surface of the wall of the vessel cavity and the surface of the lid are precleaned to be essentially contaminant-free. A precooled refrigerant sleeve removably jackets the vessel to maintain the precooled material within a predetermined temperature range for a given period of time. The refrigerant sleeve has an inside diameter adjacent an outside diameter of the vessel.

The generally cylindrical primary safeguard assembly encloses the refrigerant-jacketed vessel and its lid and comprises a receptacle and a cover. The receptacle has a contiguous wall defining an opening and a cylindrical cavity for receiving the refrigerant-jacketed vessel and lid in sealing engagement therewith through the opening. The cavity has an inside diameter adjacent an outside diameter of the refrigerant sleeve. The receptacle also has upper and lower sorbent pads within its cavity. The upper and lower sorbent pads are respectively compressed between the upper end of the receptacle and the lid and between a lower end of the vessel and a bottom wall of the receptacle. The cover seals the opening of the receptacle.

In another embodiment, the shipper for transporting materials which must be precooled and maintained within a predetermined temperature range for a given period of time, comprises a generally cylindrical vessel having a contiguous wall defining a vessel cavity and a port formed adjacent an upper end of the vessel for receiving precooled material. The shipper of this embodiment further comprises a lid for sealably engaging with the port having an inert surface adjacent to the vessel cavity. An inner surface of the wall of the vessel cavity and the surface of the lid are precleaned to be essentially contaminant-free. A precooled refrigerant sleeve removably jackets the vessel to maintain the precooled material within a predetermined temperature range for a given period of time, the sleeve having an inside diameter adjacent an outside diameter of the vessel. The refrigerant comprises a flexible, elongated bag made of inert and impermeable material jacketing the vessel and the elongated bag defines a sealed reservoir containing an aqueous gel. This embodimemt further comprises a generally cylindrical primary safeguard assembly for enclosing the jacketed vessel. The primary safeguard comprises a receptacle having a contiguous wall defining an opening and a cylindrical cavity for receiving the refrigerant-jacketed vessel and lid in sealing engagement therewith through the opening. The cylindrical cavity has an inside diameter adjacent an outside diameter of the refrigerant sleeve, a cover for sealing the opening of the receptacle, and upper and lower sorbent pads respectively for compression between the upper end of the vessel and the cover and between a lower end of the vessel and a bottom wall of the receptacle. In this embodiment, a secondary safeguard assembly encloses the primary safeguard assembly. The secondary safeguard comprises an outer structual member, a liquid impermeable liner adjacent to an inner surface of the structural member, and a layer of thermal insulation disposed between the liner and the primary safeguard assembly. The outer structural member comprises at least one rigid side wall, a bottom wall and a closable top defining an interior cavity capable of containing the primary safeguard. The thermal insulation is disposed within the interior cavity of the outer structural member flush against the liner adjacent the wall of the outer structural member. The thermal insulation defines an indentation for receiving the primary safeguard. The indentation has a cylindrical contour with an inside diameter adjacent to the outside diameter of the primary safeguard assembly. The insulation has sorbency to contain spills or leakage and is shock absorbing to cushion the primary safeguard assembly. The insulation further comprises a bottom section and a removable top section for positioning the primary safeguard assembly within the indentation.

The present invention is also directed to a method for shipping materials which must be precooled and maintained within a predetermined temperature range for a given period of time. The method comprises the steps of (1) placing precooled material within a precleaned vessel having a contiguous wall defining a vessel cavity and a port for receiving precooled material, (2) sealably engaging the port with a precleaned lid having an inert liner adjacent to the vessel cavity, (3) jacketing a precooled refrigerant around the vessel so that the refrigerant maintains the precooled material within a predetermined temperature range for a given period of time, (4) placing the refrigerant-jacketed vessel and the lid within a primary safeguard assembly comprising a receptacle having a contiguous wall defining an opening and a receptacle cavity for receiving the refrigerant-jacketed vessel and lid in sealing engagement therewith through the opening, (5) placing a sorbent between the vessel and the receptacle wall, (6) sealably engaging the opening of the receptacle with a cover, (7) placing the primary safeguard containing the refrigerant-jacketed vessel and the lid within a secondary safeguard assembly comprising an outer structual member, a liquid impermeable liner adjacent to an inner surface of the structural member, and a layer of thermal insulation disposed between the liner and the primary safeguard assembly, the thermal insulation having an indentation for receiving the primary safeguard assembly, (8) transporting the assembled secondary safeguard containing the assembled primary safeguard to a remote location, (9) opening the secondary safeguard assembly and removing the primary safeguard assembly, (10) removing the refrigerant jacket from the vessel and opening the vessel to remove the material therein, and (11) completing steps (1) through (10) in a period of time sufficient to maintain the precooled material within the predetermined temperature range.

Each of the apparatus embodiments of the present invention can provide changes and modifications that are applicable for specific applications of the present invention. For example, the shipper can have a lid wherein the surface of the lid includes an inert liner. The receptacle and the cover can be made of inert material impermeable to fluids. The sorbent can be comprised of compressed cellulose sponge with varying aqueous absorbent capacity. In a preferred embodiment,the aqueous absorbent capacity of the sorbent is at least 1000 milliliters.

In another embodiment, the sorbent is comprised of at least one sorbent pad disposed adjacent to a bottom wall of the receptacle and at least one sorbent pad disposed adjacent to the cover wherein the vessel is disposed between the sorbent pads. In still another embodiment, the sorbent is comprised of a sorbent sleeve disposed within the receptacle cavity adjacent an inner surface of the wall of the receptacle to form a sleeve around the refrigerant and the vessel to cushion and insulate the vessel. The refrigerant can be comprised of a flexible, elongated bag made of inert and impermeable material jacketing the vessel, the elongated bag defining a sealed reservoir containing an aqueous gel. The outer structural member is comprised of at least one rigid side wall, a bottom wall and a closable top defining an interior cavity capable of containing the primary safeguard assembly.

The thermal insulation can be disposed within the interior cavity of the outer structural member flush against the liner adjacent to the wall of the outer structural member, and the thermal insulation defines an indentation for receiving the primary safeguard. The insulation can further comprise a bottom section and a removable top section for positioning the primary safeguard assembly. The insulation may also have sorbency to absorb spills or leakage and is shock absorbing to cushion the primary safeguard assembly.

Additional protection for the vessel in the apparatus embodiments may be provided by a secondary safeguard assembly enclosing the primary safeguard assembly. The secondary safeguard comprises an outer structual member, a liquid impermeable liner adjacent to an inner surface of the structural member, and a layer of thermal insulation disposed between the liner and the primary safeguard assembly. The outer structural member comprises at least one rigid side wall, a bottom wall and a closable top defining an interior cavity capable of containing the primary safeguard, the thermal insulation disposed within the interior cavity of the outer structural member is flush against the liner adjacent the wall of the outer structural member. The thermal insulation defines an indentation for receiving the primary safeguard, the indentation being a cylindrial indentation with an inside diameter adjacent to the outside diameter of the primary safeguard assembly. The insulation has sorbency to contain spills or leakage and is shock absorbing to cushion the primary safeguard assembly. The insulation may further comprise a bottom section and a removable top section for positioning the primary safeguard assembly within the indentation.

DETAILED DESCRIPTION OF THE PREFERRED EMBODIMENTS

Figure 1:
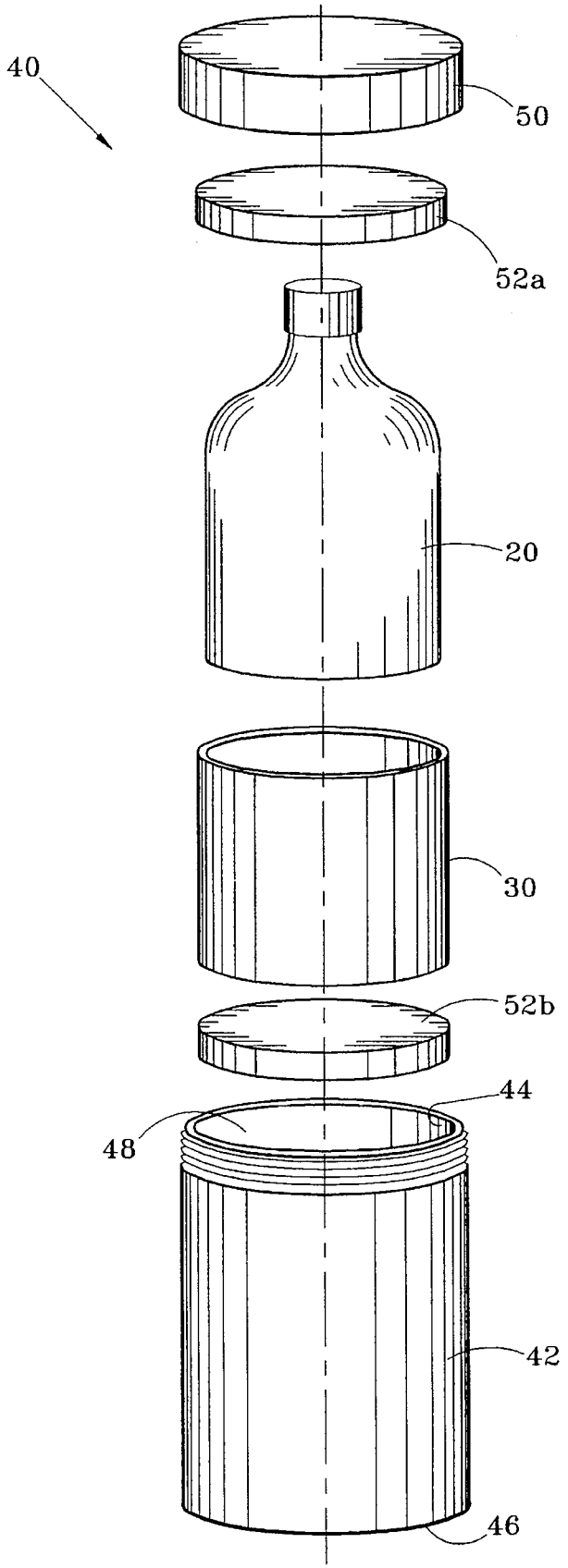
FIG. 1 is a perspective, exploded view of a primary safeguard of the present invention prior to assembly.

Referring now to the drawings in which like parts are referenced by like numerals, the purpose of the shipper 10 is to safely transport glass or plastic vessels 20 containing materials which must be precooled and maintained within a predetermined temperature range for a given period of time. Samples of various specimens are taken from environmental sites, geological sites, agriculture sites and other experimental sites and include pesticides, soil specimens, biological specimens etc. for the purpose of shipping to laboratories for testing, or analysis, for example. These materials may be either organic or inorganic, as well as hazardous or nonhazardous. The method of shipping may include air freight or ground transportation.

Two critical features must be present for the safe transport of the hazardous or less stable specimens. First, the material should be maintained within a temperature range that slows down both chemical reactions and biological activity for a given period of time, typically at least 24 hours. Second, because of the possible hazardous nature of some of these samples, safeguards must be used reduce the possibility of breakage or leakage from the primary containers and, if breakage does occur, to lessen the possibility of the escape of fluids to the atmosphere. The shipper 10 of this invention has a refrigerant to maintain a predetermined temperature range typically between 0.5° C. and 5.0° C. for a given period of time, typically at least 24 hours.

The shipper 10 also comprises a safeguard system 40 to cushion the vessels thereby lessening the possibility of breakage of vessels 20 used to contain the materials or, in the event breakage does occurs, to greatly reduce the possibility of leakage of the materials from the shipper 10.

Figure 5:
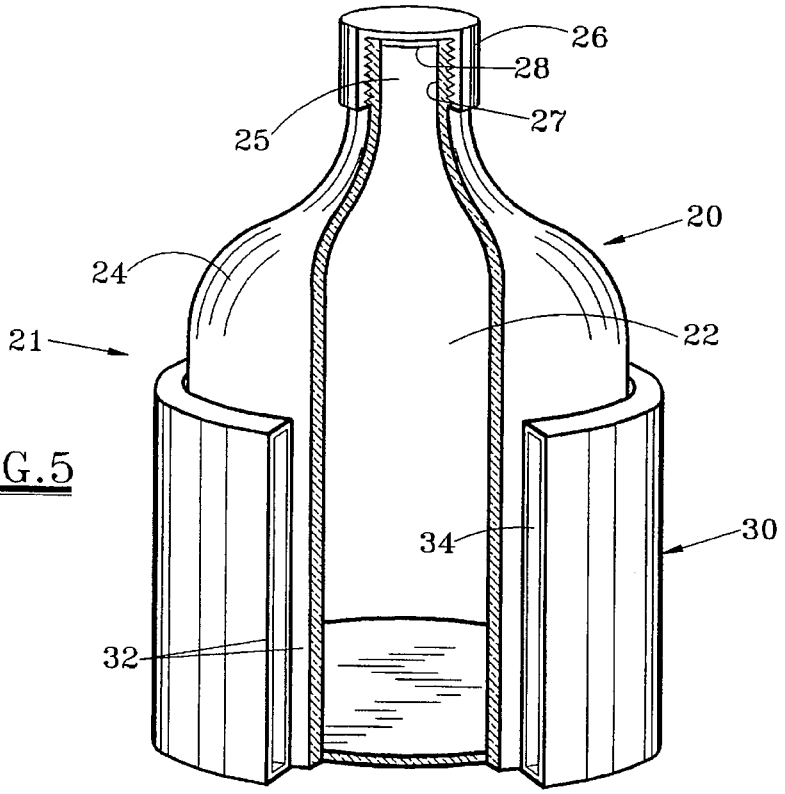
FIG. 5 is a perspective view of a vessel and refrigerant jacketing the vessel according to one embodiment of the present invention.
Figure 6:
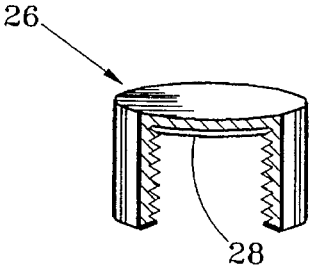
FIG. 6 is a cross-sectional view of a lid of the vessel of FIG. 5.

FIG. 1 depicts an embodiment of the shipper of this invention illustrating both the refrigerant 30 and the first or primary safeguard assembly 40 for preventing breakage or possible leakage of the sample materials. Preferrably, the vessel 20 used to contain the material may be made from, for example, a borosilicate glass or a plastic such as high density polyethylene, both substances being inert to most materials within the temperature range of 0° C. to 100° C. at atmospheric pressures ranging from 1 to 2 atmospheres, and essentially impervious to acids and bases. The vessel 20, as best seen in FIG. 5, has a contiguous wall 24 defining a cavity 22 for containing the sample material. The wall 24 also defines a port 25 for receiving the precooled sample material. The shipper 10 further comprises a lid 26 for sealably engaging with the port 25 after the sample material has been placed within the vessel 20. The lid 26 has an inert surface 27 adjacent to the the vessel 22. The lid 26, in a preferred embodiment, is a polypropylene or phenolic cap. It is also preferrable to have a liner 28 (see FIG. 6) for the lid adjacent to the inner surface 27. The liner is formed from an inert substance, such as, for example, polyethylene. Beneficially, the liner is formed from a synthetic resin polymer polytetrafluoroethylene readily available under the tradename TEFLON. The vessel 20 and its lid 26 may vary in both size and shape and different embodiments of this invention accommodate this multiformity.

A variety of factors affecting the choice of containers include resistance to breakage, size, weight, interferences with the analyses of interest, cost and availability. Table 1 below lists the types of containers used for shipping samples and describes the physical characteristics of both the vessels 20 and the lids 26 including volume capacity, composition (glass or plastic), physical shape, type of closure, and total weight.

TABLE 1

SAMPLE CONTAINER SPECIFICATIONS

| Container Type | Specifications |
|---|---|
| A. | Container: 80-oz amber glass, ring handle bottle/jug, 38-mm neck finish.<br>Closure: polypropylene or phenolic cap, 38-430 size; 0.015-in Teflon liner.<br>Total Weight: 2.45 lbs. |
| B. | Container: 40-ml glass vial, 24-mm neck finish.<br>Closure: polypropylene or phenolic, open-top. screw cap, 15-cm opening, 24-400 size.<br>Septum: 24-mm disc of 0.005-in Teflon bonded to 0.120-in silicon for total thickness of 0.125-in.<br>Total Weight: 0.72 oz. |
| C. | Container: 1-L high-density polyethylene, cylinder-round bottle, 28-mm neck finish.<br>Closure: polyethylene cap, ribbed, 28-410 size; F217 polyethylene liner.<br>Total Weight: 1.89 oz. |
| D. | Container: 120-mL wide mouth, glass vial, 48-mm neck finish.<br>Closure: polypropylene cap, 48-400 size; 0.015-in Teflon liner.<br>Total Weight: 4.41 oz. |

TABLE 1-continued

SAMPLE CONTAINER SPECIFICATIONS

| Container Type | Specifications |
|---|---|
| E. | Container: 16-oz tall, wide mouth, straight-sided, flint glass jar, 63-mm neck finish.<br>Closure: polypropylene or phenolic cap, 63-400 size; 0.015-in Teflon liner.<br>Total Weight: 9.95 oz. |
| F. | Container: 8-oz short, wide mouth, straight-sided, flint glass jar, 70-mm neck finish.<br>Closure: polypropylene or phenolic cap, 70-400 size; 0.015-in Teflon liner.<br>Total Weight: 7.55 oz. |
| G. | Container: 4-oz tall, wide mouth, straight-sided, flint glass jar, 48-mm neck finish.<br>Closure: polypropylene or phenolic cap, 48-400 size; 0.015-in Teflon liner.<br>Total Weight: 4.70 oz. |
| H. | Container: 1-L amber, Boston round, glass bottle, 33-mm pour-out neck finish.<br>Closure: polypropylene or phenolic cap, 33-430 size; 0.015-in Teflon liner.<br>Total Weight: 1.11 lbs. |
| J. | Container: 32-oz tall, wide mouth, straight-sided, flint glass jar, 89-mm neck finish.<br>Closure: polypropylene or phenolic cap, 89-400 size; 0.015-in Teflon liner.<br>Total Weight: 1.06 lbs. |
| K. | Container: 4-L amber glass, ring handle bottle/jug, 38-mm neck finish.<br>Closure: polypropylene or phenolic cap, 38-430 size; 0.015-in Teflon liner.<br>Total Weight: 2.88 lbs. |
| L. | Container: 500-mL high-density polyethylene, cylinder-round bottle, 28-mm neck finish.<br>Closure: polypropylene cap, ribbed, 28-410 size; F217 polypropylene liner.<br>Total Weight: 1.20 oz. |

The vessel 20 of the preferred embodiments may be straight-sided (not shown) or neck finished as illustrated in FIG. 5, and range in capacity from 40 milliliters to one liter. The lid 26 for the preferred embodiments varies respectively to the vessel 20.

Figure 4:
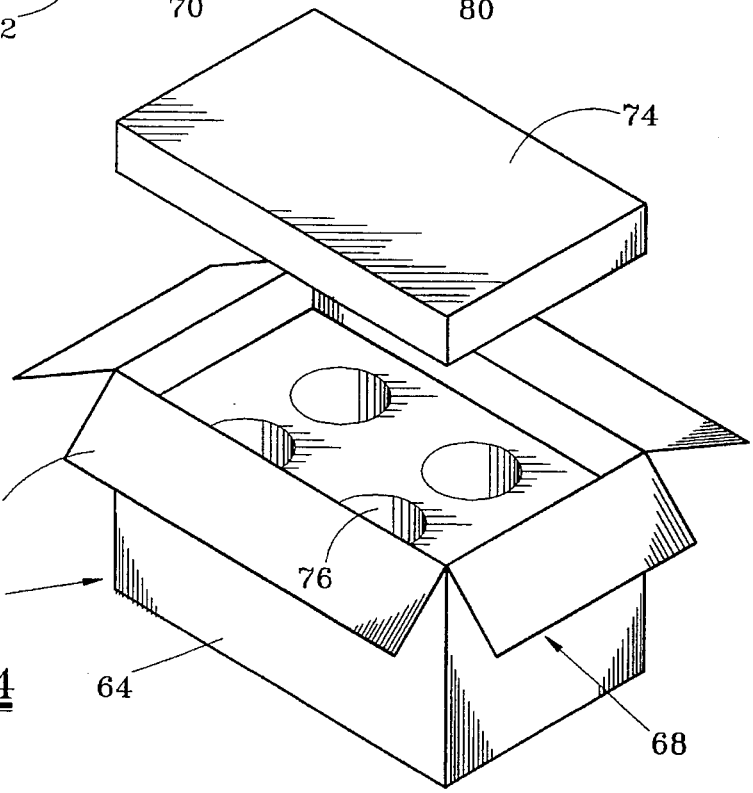
FIG. 4 is a perspective exploded view of the shipper of FIG. 2 showing the top and bottom sections of the insulation.

More than one vessel may be transported by the shipper at any given time. In a preferred embodiment the shipper may transport 2, 4 or 6 vessels 20. FIG. 4 illustrates a shipper 10 capable of shipping four vessels contained within primary safeguard assemblies 40.

In one preferred embodiment of the shipper 10, the vessel 20, lid 26 and lid liner 28 are precleaned and tested so as to be essentially contaminant-free. As used herein, the vessel is essentially contaminant-free if it meets the guidelines for the detectable limits of contaminants as shown in Table 2, Inorganic Analyte Specifications, Table 3, Organic Compound Specifications-Volatiles, and Table 4, Organic Compound Specifications-Semivolatiles.

TABLE 2

INORGANIC ANALYTE SPECIFICATIONS

| Analyte | CAS Number | Minimum Required Detection Limits (ug/L) |
|---|---|---|
| 1. Aluminum | 7429-90-5 | 100 |
| 2. Antimony | 7440-36-0 | 5 |
| 3. Arsenic | 7440-38-2 | 2 |

TABLE 2-continued

| Analyte | CAS Number | Minimum Required Detection Limits (ug/L) |
|---|---|---|
| INORGANIC ANALYTE SPECIFICATIONS | | |
| 4. Barium | 7440-39-3 | 20 |
| 5. Beryllium | 7440-41-7 | 1 |
| 6. Cadmium | 7440-43-9 | 1 |
| 7. Calcium | 7440-70-2 | 500 |
| 8. Chromium | 7440-47-3 | 10 |
| 9. Cobalt | 7440-48-4 | 10 |
| 10. Copper | 7440-50-8 | 10 |
| 11. Iron | 7440-89-6 | 500 |
| 12. Lead | 7439-92-1 | 2 |
| 13. Magnesium | 7439-95-4 | 500 |
| 14. Manganese | 7439-96-5 | 10 |
| 15. Mercury | 7439-97-6 | 0.2 |
| 16. Nickel | 7440-02-0 | 20 |
| 17. Potassium | 7440-09-7 | 750 |
| 18. Selenium | 7782-49-2 | 3 |
| 19 Silver | 7440-22-4 | 10 |
| 20. Sodium | 7440-13-5 | 500 |
| 21. Thallium | 7440-28-0 | 10 |
| 22. Vanadium | 7440-62-2 | 10 |
| 23. Zinc | 7440-66-6 | 20 |
| 24. Cyanide | 57-12-5 | 10 |
| 25. Fluoride | 16984-48-8 | 200 |
| 26. Nitrate/Nitrite | 1-00-5 | 100 |

[1]MRDLs are based on the Contract Laboratory Program. (CLP) Inorganics Low Concentration State,emt of Work Requirements. (SOW)

TABLE 3

| Volatiles | CAS Number | Minimum Required Quantitation Limits (ug/L) |
|---|---|---|
| ORGANIC COMPOUND SPECIFICATIONS | | |
| 1. Chloromethane | 74-87-3 | 1 |
| 2. Bromomethane | 74-83-9 | 1 |
| 3. Vinyl Chloride | 75-01-4 | 1 |
| 4. Chloroethane | 75-00-3 | 1 |
| 5. Mathylane Chloride | 75-09-2 | 2 |
| 6. Acetone | 67-64-1 | 5 |
| 7. Carbon Disulfide | 75-15-0 | 1 |
| 8. 1.1-dichloroethene | 75-35-4 | 1 |
| 9. 1.1-Dichloroethane | 75-34-3 | 1 |
| 10. cis-1,2-Dichloroethene | 156-59-4 | 1 |
| 11. trans-1,2-Dichloroethene | 156-60-5 | 1 |
| 12. Chloroform | 67-66-3 | 1 |
| 13. 1,2-Dichloroethane | 107-06-2 | 1 |
| 14. 2-Butanone | 78-93-3 | 5 |
| 15. Bromochloromethane | 74-97-5 | 1 |
| 16. 1,1,1-Trichloroethane | 71-55-6 | 1 |
| 17. Carbon Tetrachloride | 56-23-5 | 1 |
| 18. Bromodichloromethane | 75-27-4 | 1 |
| 19. 1,2-Dichloropropane | 78-87-5 | 1 |
| 20. cis-1,3-Dichloropropene | 10061-00-5 | 1 |
| 21. Trichloroethene | 79-01-6 | 1 |
| 22. Dibromochloromethane | 124-48-1 | 1 |
| 23. 1,1,2-Trichloroethane | 79-00-5 | 1 |
| 24. Benzene | 71-43-2 | 1 |
| 25. trans-1,3-Dichloropropene | 10061-02-6 | 1 |
| 26. Bromoform | 75-25-2 | 1 |
| 27. 4-Methyl-2-Pentanone | 108-10-1 | 5 |
| 28. 2-Hexanone | 591-78-6 | 5 |
| 29. Tetrachloroethene | 127-18-4 | 1 |
| 30. 1,1,2,2-Tetrachloroethane | 79-34-5 | 1 |

[1]MRQLs are based on the CLP Organics Low Concentration SOW.

TABLE 4

| Semivolatiles | CAS Number | Minimum Required Quantitation Limits (ug/L) |
|---|---|---|
| ORGANIC COMPOUND SPECIFICATIONS (Continued) | | |
| 1. Phenol | 108-95-2 | 5 |
| 2. bis-(2-Chlorethyl)ether | 111-44-4 | 5 |
| 3. 2-Chloropenol | 95-57-8 | 5 |
| 4. 2-Methylphenol | 95-57-8 | 5 |
| 5. 2,2'-oxybis-(1-Chloropropane) | 108-60-1 | 5 |
| 6. 4-Methylphenol | 106-44-5 | 5 |
| 7. N-Nitroso-di-n-dipropylamine | 621-64-7 | 5 |
| 8. Hexachloroethane | 67-72-1 | 5 |
| 9. Nitrobenzene | 98-95-1 | 5 |
| 10. Isophorone | 78-59-1 | 5 |
| 11. 2-Nitrophenol | 88-75-5 | 5 |
| 12. 2,4-dimethylphenol | 105-67-9 | 5 |
| 13. bis-(2-Chloroethoxy)methane | 111-67-9 | 5 |
| 14. 2,4-Dichlorophenol | 120-83-2 | 5 |
| 15. 1,2,4-Trichlorobenzene | 120-82-1 | 5 |
| 16. Naphthalene | 91-20-3 | 5 |
| 17. 4-Chloroaniline | 106-47-8 | 5 |
| 18. Hexachlorobutadiene | 87-68-3 | 5 |
| 19. 4-Chloro-3-methylphanol | 59-50-7 | 5 |
| 20. 2-Mathylanphthalene | 91-57-6 | 5 |
| 21. Hexachlorocyclopentadiene | 77-47-4 | 5 |
| 22. 2,4,6-Trichlorophenol | 88-06-2 | 5 |
| 23. 2,4,5-Trichlorophenol | 95-06-4 | 20 |
| 24. 2-Chloronaphthalene | 91-58-7 | 5 |
| 25. 2-Nitroaniline | 88-74-4 | 20 |
| 26. Dimethylphthalate | 131-11-3 | 5 |
| 27. Acenaphthylene | 208-96-8 | 5 |
| 28. 2,6-Dinitrotoluene | 606-20-2 | 5 |
| 29. 3-Nitroaniline | 99-09-2 | 20 |
| 30. Acenaphthene | 83-32-9 | 5 |
| 31. 2,4-Dinitrophenol | 51-28-5 | 20 |
| 32. 4-Nitrophenol | 100-02-7 | 20 |
| 33. Dibenzofuran | 132-64-9 | 5 |
| 34. 2,4-Dinitrotoluene | 121-14-2 | 5 |
| 35. Diethylphthalate | 84-66-2 | 5 |
| 36. 4-Chlorophenyl-phenylether | 7005-72-3 | 5 |
| 37. Fluorene | 86-73-7 | 5 |
| 38. 4-Nitroaniline | 100-01-6 | 20 |
| 39. 4,6-Dinitro-2-methylphenol | 534-52-1 | 20 |
| 40. N-Nitrosodiphenylamine | 86-30-6 | 5 |
| 41. 4-Bromophenyl-phenlether | 101-55-3 | 5 |
| 42. Hexachlorobenzene | 118-74-1 | 5 |
| 43. Pentachlorophenol | 87-86-5 | 20 |
| 44. Phenanthrene | 85-01-8 | 5 |
| 45. Anthracene | 120-12-7 | 5 |
| 46. Di-n-butylphthalate | 84-74-2 | 5 |
| 47. Fluoranthene | 206-44-0 | 5 |
| 48. Pyrene | 129-00-0 | 5 |
| 49. Butylbenzylphthalate | 85-68-7 | 5 |
| 50. 3,3'-Dichlorobenzidine | 91-94-1 | 5 |
| 51. Benz [a] anthracene | 56-55-3 | 5 |
| 52. Chyrsene | 218-01-9 | 5 |
| 53. bis-(2-Ethylhexyl)phthalate | 117-81-7 | 5 |
| 54. Di-n-octylphthalate | 117-84-0 | 5 |
| 55. Benzo [b] Fluoranthene | 205-99-2 | 5 |
| 56. Benzo [k] fluoranthene | 207-08-9 | 5 |
| 57. Benzo [a] pyrene | 50-32-8 | 5 |
| 58. Indeno (1,2,3-cd)pyrene | 193-39-5 | 5 |
| 59. Dibenz [a,h] anthracene | 53-70-3 | 5 |
| 60. Benzo [g,h,i]perylena | 191-24-2 | 5 |

[1]MRQLs are based on the CLP Organics Low Concentration SOW.

Depending on the type of sample material to be shipped and the possible contaminants, the vessels 20, lids 26, and lid liners 28 are precleaned by a method utilizing from one to four washes with nonphosphate detergents, multiple tap water and deionized water rinses and oven drying for example, as described in ESS Sample Container Preparation and Cleaning Procedures, April, 1992 which is hereby incorporated herein by reference. A nitric acid rinse may also be used for samples requiring metal, cyanide, sulfide and floride analysis. Sulfuric acid rinses are preferably used for samples requiring nitrate/nitrite analysis.

Prior to being placed in the shipper 10 of this invention, the vessels 20 containing their sample materials are pre-cooled to a predetermined temperature, typically ranging from 0.5° C. to 5.0° C. A refrigerant 30 engages with the vessel 20 so that the desired temperature range may be maintained for a given period of time, at least 24 hours. The preferred embodiments of this invention use a refrigerant 30 which removably jackets the vessel 20. Preferrably, the refrigerant 30 wraps around the vessel 20 as shown in FIGS. 1 and 5. In this position, the refrigerant 30 provides cushioning to stabilize the vessel 20 as well as shock absorbency to lessen the possibilty of breakage.

The refrigerant preferably comprises a flexible, elongated bag 32 made of a substance that is inert and impermeable to most materials. The elongated bag 32 defines a sealed reservoir 34 for containing an aqueous solution consisting essentially of conventional mineral salts and water; an alcohol is used as a preservative. Beneficially, the aqueous solution is in the form of a conventional gel. Increased cooling capacity may be achieved by increasing the volume of gel surrounding the vessel 20. In a preferred embodiment, the elongated bag is made from a plastic which is sealed after receiving the aqueous gel. The nature and heat capacity of the refrigerant 30 will vary with different embodiments of this invention. In one preferred embodiment, the refrigerant has a heat capacity of approximately 0.5 calories/gram/° C. Although ice or dry ice may be used as a refrigerant 30, these refrigerates are not preferred because of the weight and the possibility of contamination of the sample material.

In one embodiment of the shipper 10, the refrigerant 30 contains approximately 480 grams of gel. As depicted in FIG. 1, the refrigerant 30 has flexibility for wrapping, around the vessel 20.

As illustrated in FIG. 1, the refrigerant-jacketed vessel 21, and the lid 26 in sealing engagement therewith, are placed in a primary safeguard assembly 40. The primary safeguard assembly 40 comprises a receptacle 42 having a contiguous wall 44 defining an opening 48 and a receptacle cavity for receiving the refrigerant-jacketed vessel 21 and lid 26. After the refrigerant-jacketed vessel 21 is placed into the receptacle 42, a cover 50 is used to seal the receptacle opening 48. If desired, a gasket of inert material (not shown) is positioned between the openings 45 and the receptacle cover 50. Both the receptacle 42 and cover 50 are formed from substances that are inert to most materials and that are impermeable to most fluids, such as, for example high density polyethylene.

The primary safeguard assemble 40 of the shipper 10 preferably includes comprises a sorbent disposed between the vessel 20 and the receptacle wall 44. In a preferred embodiment of the invention, the sorbent is comprised of compressed cellulose sponge having an aqueous absorbent capacity of at least 1000 milliliters. In the practice of this invention, other sorbent materials well known in the art may be used, such as, polyolefin microfiber, for example. In a preferred embodiment, the sorbent is in the form of pads **52*a* and 52*b* (see FIG. 1.) One sorbent pad 52*a* is disposed adjacent to a cover 50 and the other sorbent pad 52*b* is adjacent to bottom wall 46 of the receptacle 42 so that the vessel 20 is disposed between the sorbent pads 52*a* and 52*b*. In this manner, the sorbent pads 52*a*, 52*b* provide additional stabilizing and cushioning to the refrigerant-jacketed vessel 21** as well as absorption capabilities.

Figure 7:
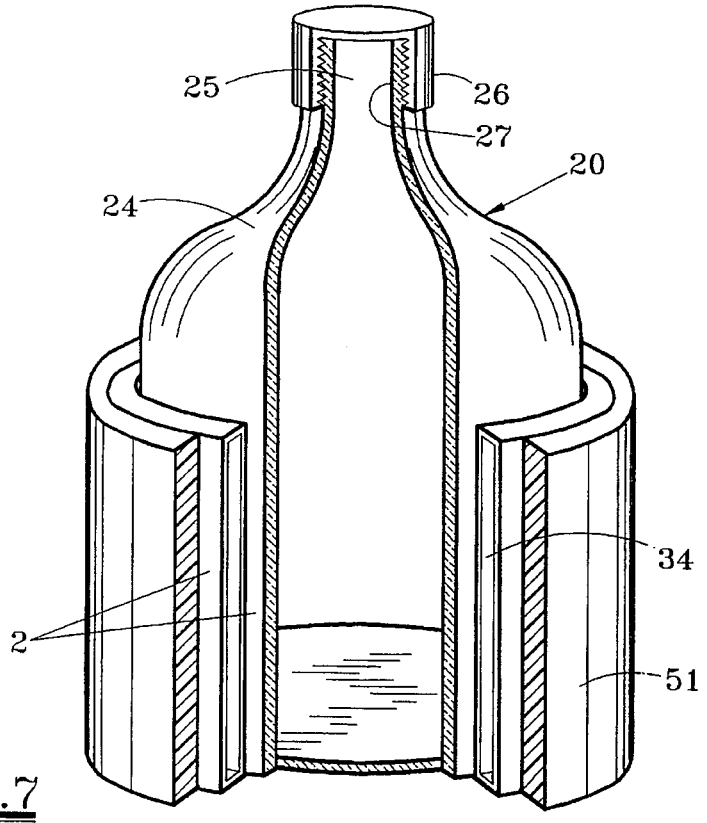
FIG. 7 is a schematic view of a shipper of the present invention depicting a sorbent sleeve around a refrigerant-jacketed vessel.

In another embodiment of the shipper 10 as shown in FIG. 7, the sorbent 51 is disposed within the receptacle cavity 48 adjacent an inner surface of the receptacle wall 44 forming a sleeve around the refrigerant-jacketed vessel 20 to cushion and insulate the vessel 20.

In one preferred embodiment of the shipper 10 depicted in FIG. 1, both the receptacle 42 and the vessel 20 are cylindrical in shape. The diameter of the cylindrical receptacle 42 is greater than the refrigerant-jacketed vessel 20 so as to allow for the insertion and removal there of. The axial length of the receptacle 42 is also greater than the axial length of the vessel 20. By way of example, a 3360 milliliter receptacle 42 is suitable for vessels 20 varying in capacity from 40 milliliters to 1000 milliliters.

Figure 2:
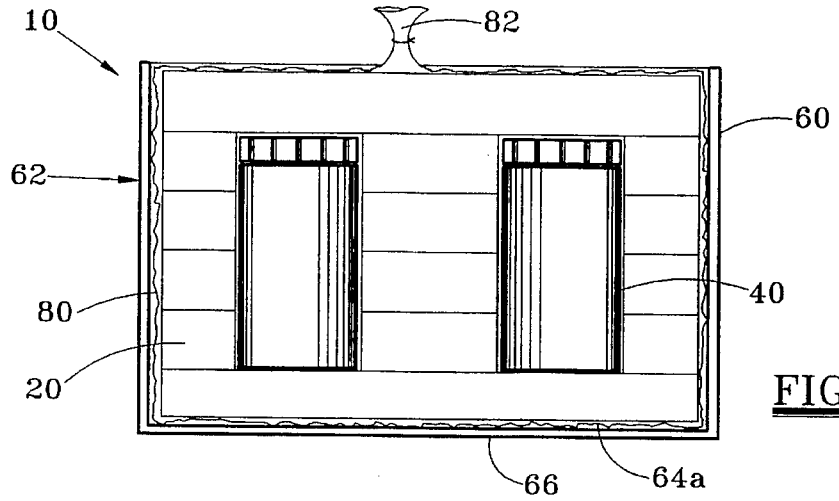
FIG. 2 is a cross-sectional view of a shipper of the present invention containing the primary safeguard assembly of FIG. 1.

Referring now to FIG. 2, a secondary safeguard assembly 60 is depicted enclosing the primary safeguard assembly 40. The secondary safeguard assembly 60 comprises an outer structural member 62, a liquid impermeable liner 80 adjacent to an inner surface of the outer structural member 64 and a layer of thermal insulation 70 disposed between the liner 80 and the primary safeguard assembly 40.

Figure 3:
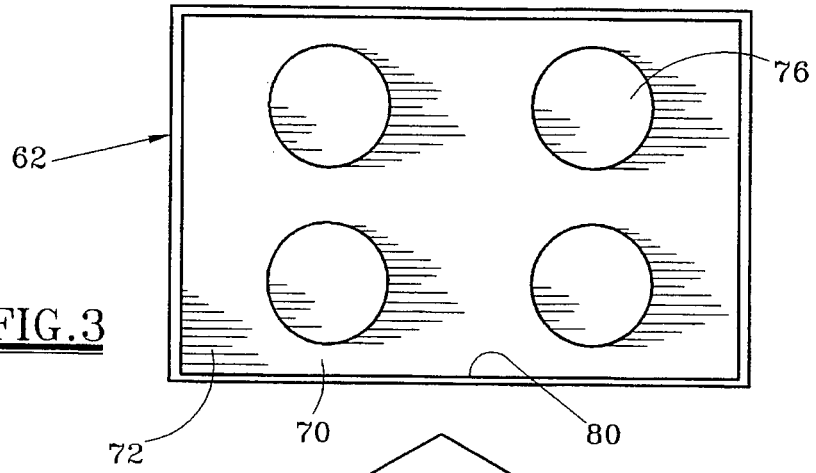
FIG. 3 is a plan view of the shipper of FIG. 2 illustrating indentations in insulation.

FIGS. 2, 3 and 4 illustrate the thermal insulation 70 of the shipper 10. The thermal insulation is disposed within the interior cavity of the outer structural member flush against the liner 80. The thermal insulation 70 defines indentations 76 for receiving the primary safeguard assembly 40. The number of indentations 76 may vary depending on the size of the primary safeguard 40 and the outer structural member 62. Four indentations are illustrated in the embodiment depicted by FIGS. 3 and 4. Preferably the indentation 76 is cylindrical with an inside diameter adjacent to the outside diameter of the primary safeguard assembly 40.

The thermal insulation 70 is formed from materials which are both shock absorbing to cushion the primary safeguard assembly 40 as well as insulating to maintain the desired, temperature range. Preferably, the insulation 70 is formed from polyurethane foam. Benefically, the insulation 70 is formed from a relatively high density polyether foam to provide improved cushioning.

Preferably, the outer structural member 62 is a fiberboard box 62 having a closable top 68. The fiberboard box 62 may be solid or corrugated. Beneficially, the fiberboard box is double-walled for rigidity and is impact resistant under drop test conditions. The drop test is performed on boxes filled to not less then 95% of maximum capacity in the case of solids and not less than 98% of maximum capacity for liquids. The drop orientation of the samples of fiberboard boxes tested are: first drop (1st sample) flat on its bottom, second drop (2nd sample) flat on its top, third drop (3rd sample) flat on its long side, fourth drop (4th sample) flat on its short side and fifth drop (5th sample—on a corner). The test boxes are dropped onto a target that is a rigid, non-resilient, flat and horizontal surface. Drop heights vary up to 5.9 feet according to the materials to be transported. Beneficially, a glutable coating that imparts water and grease resistance to the fiberboard box is desirable to increase its usefulness. FIG. 2 and FIG. 4 illustrate an outer structural member comprising rigid side walls 64, a bottom wall 66 and a closable top 68. The joints are lapped and glued. The closable top 68 comprises four foldable flaps 69. The outer structural member 62 is sealed by folding the four flaps 69 inward and using a suitable adhesive tape (not shown).

Referring to FIG. 2, the liner 80 is flexible and generally fluid impermeable. Preferably, the liner 80 is an impact resistant plastic bag wherein the plastic is formed from 2–4 mil. polyethylene. The liner 80 is disposed between the inner surface 64*a* of the outer structure 62 and the thermal insulation 70 so as to enclose the insulation 70. The liner 80 has an end 82 extending above the thermal insulation 70. Prior to closing the outer structure 62, the liner end 82 may be tied off to form a seal as illustrated in FIG. 2.

The shipper 10 can be used in a method for shipping materials which must be precooled and maintained within a predetermined temperature range for a given period of time. The precooled material is placed within the precleaned vessel 20. The port is sealed with the precleaned lid 26 with the inert liner 27 adjacent to the vessel cavity. The precooled refrigerant 34 is jacketed around the vessel 26 so that the refrigerant 34 maintains the precooled material within the predetermined temperature range for the given period of time. The refrigerant-jacketed vessel 20 with the engaged lid 26 are then placed within the primary safeguard assembly 40, with sorbent 51 between the vessel 20 and the receptacle 42. The opening 48 of the receptacle 42 is then closed with the cover 50. The primary safeguard 40, containing the refrigerent jacketed vessel 20 and the engaged lid, 26 is in turn placed within an indentation in the bottom section of insulation 72 in the secondary safeguard assembly 60. The top layer of insulation 74 is placed in the secondary assembly 60, the liner 80 closed at closure 82, and the flaps 69 are folded into place and taped shut. The assembled secondary safeguard 60 containing the assembled primary safeguard 40 is transported to a remote location. Upon arrival at the destination, the secondary safeguard assembly 60 is opened and the primary safeguard assembly 40 removed. The vessel 20 is then removed form the primary safeguard 40 and the vessel 20 opened to remove the material therein. The procedure is completed in a sufficient period of time to maintain the precooled materials within the predermined temperature range.

The foregoing description is illustrative and explanatory of preferred embodiments of the invention, and variations in the size, shape, materials and other details will become apparent to those skilled in the art. It is intended that all such variations and modifications which fall within the scope or spirit of the appended claims be embraced thereby.

We claim:

1. A shipper for transporting materials which must be precooled and maintained within a predetermined temperature range for a given period of time comprising:

a vessel having a contiguous wall defining a vessel cavity and a port for receiving precooled material;

a lid for sealably engaging with the port, the lid having an inert surface adjacent to the vessel cavity;

a precooled refrigerant for removably jacketing the vessel to maintain the precooled material within a predetermined temperature range for a given period of time;

a primary safeguard assembly for enclosing the jacketed vessel comprising a receptacle having a contiguous wall defining an opening and a receptacle cavity for receiving the refrigerant-jacketed vessel and lid in sealing engagement therewith through the opening, a cover for sealing the opening of the receptacle, and a sorbent disposed between the vessel and the receptacle wall; and a secondary safeguard assembly for enclosing the primary safeguard assembly, comprising an outer structual member, a liquid impermeable liner adjacent to an inner surface of the structural member, and a layer of thermal insulation disposed between the liner and the primary safeguard assembly.

2. The shipper as defined in claim 1, wherein an inner surface of the wall of the vessel and the suface of the lid are precleaned to be essentially contaminant-free.

3. The shipper as defined in claim 1, wherein the surface of the lid includes an inert liner.

4. The shipper as defined in claim 1 wherein the receptacle and the cover are made of inert material impermeable to fluids.

5. The shipper as defined in claim 1, wherein the sorbent comprises compressed cellulose sponge having an aqueous absorbent capacity of at least 1000 milliliters.

6. The shipper as defined in claim 1, wherein the sorbent comprises at least one sorbent pad disposed adjacent to a bottom wall of the receptacle and at least one sorbent pad disposed adjacent to the cover, wherein the vessel is disposed between the sorbent pads.

7. The shipper as defined in claim 1, wherein the sorbent comprises a sorbent sleeve disposed within the receptacle cavity adjacent an inner surface of the wall of the receptacle around the refrigerant and the vessel to cushion and insulate the vessel.

8. The shipper as defined in claim 1, wherein the refrigerant comprises a flexible, elongated bag made of inert and impermeable material jacketing the vessel, the elongated bag defining a sealed reservoir containing an aqueous gel.

9. The shipper as defined in claim 1, wherein the outer structural member comprises at least one rigid side wall, a bottom wall and a closable top defining an interior cavity capable of containing the primary safeguard assembly.

10. The shipper as defined in claim 9, wherein the thermal insulation is disposed within the interior cavity of the outer structural member flush against the liner adjacent to the wall of the outer structural member, the thermal insulation defining an indentation for receiving the primary safeguard.

11. The shipper as defined in claim 10, wherein the insulation further comprises a bottom section and a removable top section for positioning the primary safegurard assembly.

12. The shipper as defined in claim 1, wherein the insulation has sorbency to absorb spills or leakage and is shock absorbing to cushion the primary safeguard assembly.

13. A shipper for transporting materials which are precooled and maintained within a predetermined temperature range for a given period of time comprising:

a vessel having a contiguous wall defining a vessel cavity and a port for receiving precooled material;

a lid for sealably engaging with the port, the lid having an inert surface adjacent to the vessel cavity, an inner surface of the wall of the vessel and the surface of the lid precleaned to be essentially contaminant-free;

a precooled refrigerant for removably jacketing the vessel to maintain the precooled material within a predetermined temperature range for a given period of time; and a primary safeguard assembly for enclosing the refrigerant-jacketed vessel comprising a receptacle having a contiguous wall defining an opening and a receptacle cavity for receiving the refrigerant-jacketed vessel and lid in sealing engagement therewith through the opening, a cover for sealing the opening of the receptacle, and a sorbent disposed between the vessel and the receptacle wall.

14. The shipper as defined in claim 13 wherein the refrigerant comprises a flexible, elongated bag made of inert and impermeable material jacketing the vessel, the elongated bag defining a sealed reservoir containing an aqueous gel.

15. A shipper for transporting materials which must be precooled and maintained within a predetermined temperature range for a given period of time comprising:

a generally cylindrical vessel having a contiguous wall defining a vessel cavity and a port formed adjacent an upper end of the vessel for receiving precooled material;

a lid for sealably engaging with the port, the lid having an inert surface adjacent to the vessel cavity, an inner surface of the wall of the vessel cavity and the surface of the lid precleaned to be essentially contaminant-free;

a precooled refrigerant sleeve for removably jacketing the vessel to maintain the precooled material within a predetermined temperature range for a given period of time, the sleeve having an inside diameter adjacent an outside diameter of the vessel;

a generally cylindrical primary safeguard assembly for enclosing the jacketed vessel comprising a receptacle having a contiguous wall defining an opening and a cylindrical cavity for receiving the refrigerant-jacketed vessel and lid in sealing engagement therewith through the opening, the cavity having an inside diameter adjacent an outside diameter of the refrigerant sleeve, a cover for sealing the opening of the receptacle, and upper and lower sorbent pads respectfully compressed between the upper end of the vessel and the lid and between a lower end of the vessel and a bottom wall of the receptacle.

16. The shipper as defined in claim 15 wherein the refrigerant comprises a flexible, elongated bag made of inert and impermeable material jacketing the vessel, the elongated bag defining a sealed reservoir containing an aqueous gel.

17. The shipper as defined in claim 15 wherein a secondary safeguard assembly encloses the primary safeguard assembly, the secondary safeguard comprising an outer structual member, a liquid impermeable liner adjacent to an inner surface of the structural member, and a layer of thermal insulation disposed between the liner and the primary safeguard assembly, the outer structural member comprising at least one rigid side wall, a bottom wall and a closable top defining an interior cavity capable of containing the primary safeguard, the thermal insulation disposed within the interior cavity of the outer structural member flush against the liner adjacent the wall of the outer structural member, the thermal insulation defining an indentation for receiving the primary safeguard, the indentation being a cylindrial indentation with an inside diameter adjacent to the outside diameter of the primary safeguard assembly, the insulation having a sorbency to contain spills or leakage and being shock absorbing to cushion the primary safeguard assembly.

18. The shipper as defined in claim 17 wherein the insulation further comprises a bottom section and a removable top section for positioning the primary safeguard assembly within the indentation.

19. A shipper for transporting materials which must be precooled and maintained within a predetermined temperature range for a given period of time comprising:

a generally cylindrical vessel having a contiguous wall defining a vessel cavity and a port formed adjacent an upper end of the vessel for receiving precooled material;

a lid for sealably engaging with the port, the lid having an inert surface adjacent to the vessel cavity, an inner surface of the wall of the vessel cavity and the surface of the lid precleaned to be essentially contaminant-free;

a precooled refrigerant sleeve for removably jacketing the vessel to maintain the precooled material within a predetermined temperature range for a given period of time, the sleeve having an inside diameter adjacent an outside diameter of the vessel, the refrigerant comprising a flexible, elongated bag made of inert and impermeable material jacketing the vessel, the elongated bag defining a sealed reservoir containing an aqueous gel;

a generally cylindrical primary safeguard assembly for enclosing the jacketed vessel comprising a receptacle having a contiguous wall defining an opening and a cylindrical cavity for receiving the refrigerant-jacketed vessel and lid in sealing engagement therewith through the opening, the cavity having an inside diameter adjacent an outside diameter of the refrigerant sleeve, a cover for sealing the opening of the receptacle, upper and lower sorbent pads respectvely for compression between the upper end of the vessel and the cover and between a lower end of the vessel and a bottom wall of the receptacle; and a secondary safeguard assembly for enclosing the primary safeguard assembly, the secondary safeguard assembly comprising an outer structual member, a liquid impermeable liner adjacent to an inner surface of the structural member, and a layer of thermal insulation disposed between the liner and the primary safeguard assembly, the outer structural member comprising at least one rigid side wall, a bottom wall and a closable top defining an interior cavity capable of containing the primary safeguard, the thermal insulation disposed within the interior cavity of the outer structural member flush against the liner adjacent the wall of the outer structural member, the thermal insulation defining an indentation for receiving the primary safeguard, the indentation being a cylindrial indentation with an inside diameter adjacent to the outside diameter of the primary safeguard assembly, the insulation having a sorbency to contain spills or leakage and being shock absorbing to cushion the primary safeguard assembly, the insulation further comprising a bottom section and a removable top section for positioning the primary safeguard assembly within the indentation.

20. A method for shipping materials which must be precooled and maintained within a predetermined temperature range for a given period of time comprising:

(1) placing precooled material within a precleaned vessel having a contiguous wall defining a vessel cavity and a port for receiving precooled material;

(2) sealably engaging the port with a precleaned lid having an inert liner adjacent to the vessel cavity;

(3) jacketing a precooled refrigerant around the vessel so that the refrigerant maintains the precooled material within a predetermined temperature range for a given period of time;

(4) placing the refrigerant-jacketed vessel and the lid within a primary safeguard assembly comprising a receptacle having a contiguous wall defining an opening and a receptacle cavity for receiving the refrigerant-jacketed vessel and lid in sealing engagement therewith through the opening;

(5) placing a sorbent between the vessel and the receptacle wall;

(6) sealably engaging the opening of the receptacle with a cover;

(7) placing the primary safeguard containing the refrigerant jacketed vessel and the lid within a secondary safeguard assembly comprising an outer structual member, a liquid impermeable liner adjacent to an inner surface of the structural member, and a layer of thermal insulation disposed between the liner and the primary safeguard assembly, the thermal insulation having an indentation for receiving the primary safeguard assembly;

(8) transporting the assembled secondary safeguard containing the assembled primary safeguard to a remote location;

(9) opening the secondary safeguard assembly and removing the vessel from the primary safeguard assembly; and

(10) opening the vessel.

21. The method for shipping material, as defined in claim 20 wherein the steps 1 through 10 are completed in a period of time sufficient to maintain the precooled material within the predetermined temperature range.

* * * * *